US008590707B2

(12) United States Patent
Sielski

(10) Patent No.: US 8,590,707 B2
(45) Date of Patent: Nov. 26, 2013

(54) FOLDABLE TRAY FOR MAKING A PACKAGE IN WHICH TO BAKE AND SHIP BAKED GOODS

(76) Inventor: Joseph E. Sielski, Orange, CA (US)

( * ) Notice: Subject to any disclaimer, the term of this patent is extended or adjusted under 35 U.S.C. 154(b) by 301 days.

(21) Appl. No.: 12/803,432

(22) Filed: Jun. 28, 2010

(65) Prior Publication Data

US 2011/0315594 A1 Dec. 29, 2011

(51) Int. Cl.
*B65D 1/34* (2006.01)

(52) U.S. Cl.
USPC ..... 206/557; 229/169; 229/188; 229/902

(58) Field of Classification Search
USPC ..... 229/186, 187, 188, 169, 902, 903; 206/541, 546, 557
See application file for complete search history.

(56) References Cited

U.S. PATENT DOCUMENTS

| | | | | | |
|---|---|---|---|---|---|
| 3,008,626 | A | * | 11/1961 | Lawrence | 229/150 |
| 3,368,734 | A | * | 2/1968 | Wainberg | 229/143 |
| 4,114,797 | A | * | 9/1978 | Manizza | 229/169 |
| 4,308,985 | A | * | 1/1982 | Manizza et al. | 229/5.81 |
| 4,998,669 | A | * | 3/1991 | Karolyi | 229/170 |
| 5,086,971 | A | * | 2/1992 | Detzel et al. | 229/188 |

* cited by examiner

*Primary Examiner* — Jacob K Ackun
(74) *Attorney, Agent, or Firm* — Morland C. Fischer

(57) ABSTRACT

A flat foldable tray having a set of fold lines inscribed therein along which the tray is bent to form a package in which to carry a variety of products (e.g., baked goods). The flat foldable tray includes a base portion, a pair of side walls and a pair of end walls, each of which walls being hingedly connected to the base portion, and a folding corner located between each pair of adjacent side and end walls. The pairs of side and end walls are bent upwardly relative to the base portion along with the folding corners at respective fold lines such that the folding corners are located at the exterior of the package and outside the walls thereof. The pairs of side and end walls are retained in locking engagement with one another so that the walls are retained in end-to-end alignment and the package is held in a closed configuration.

6 Claims, 12 Drawing Sheets

FOLDABLE TRAY FOR MAKING A PACKAGE IN WHICH TO BAKE AND SHIP BAKED GOODS

BACKGROUND OF THE INVENTION

1. Field of the Invention

This invention relates to flat foldable paper tray having a set of fold lines inscribed therein along which the tray is bent to form a package in which to carry any one of a variety of food products, such as a baked goods, or the like. By virtue of the foregoing, a food product can be first cooked and then shipped displayed, sold and consumed within the same package to streamline the production and distribution process.

2. Background Art

Many food products intended for consumption are purchased by consumers and carried home from a place of purchase in a package. For example, it is common for baked goods to be packaged and wrapped prior to their sale. Typically, the product is first cooked in a metal base or similar cooking vessel which must be greased prior to receipt of the dough. Once the cooked product has cooled, it is removed from the cooking base and relocated to a package of the kind in which the product is sold and carried home by the consumer. The cooking base is then cleaned, dried and prepped for reuse.

The requirement for different containers in which to cook and then package the finished product for sale results in an inefficient production and distribution process. That is to say, time and labor must be devoted to transfer the product from its cooking base to a retail package and then to clean and ready the base. Time may also be wasted while waiting for the cooked product to cool before being removed from the cooking base. As a consequence of the foregoing, the cost to produce a finished baked product ready for sale is increased, which cost is usually passed on to the consumer. What is more, the bakery and/or the retail store must continuously keep on hand supplies of cooking vessels and packaging which, for large bakeries and retail chains, are known to consume valuable space. Some of the packaging may not be used until after a long delay or not at all. In this case, the packaging may ultimately be discarded to reduce space consumption.

Accordingly, it would be desirable to have a more efficient and less costly means for making, packaging and distributing cooked (e.g., baked) products from production to consumption.

SUMMARY OF THE INVENTION

Briefly, and in general, a flat, multi-purpose foldable tray is disclosed for making a package in which a food product (e.g., a baked good) can be cooked, shipped, displayed, sold and consumed. The tray is preferably manufactured from recycled corrugated paper board. The flat tray has a set of fold lines along which the tray is bent to form the package. Thus, a single package can be used from baking to consumption to streamline the production and distribution process.

According to a first preferred embodiment, the tray has a rectangular central base portion. A pair of side walls are separated from the central base portion by respective crease lines in the tray. A pair of end walls are also separated from the central base portion by respective crease lines. Each corner of the tray lying between adjacent side and end walls includes a pair of triangular fold-up panels that are formed by perforations in the tray. The fold-up panels angle outwardly from one corner of the central base portion. A locking tab is hingedly connected to one of the fold-up panels. The side and end walls of the tray are bent upwardly along their crease lines relative to the base portion to correspondingly cause each pair of triangular fold-up corner portions to be folded towards and moved face-to-face against one another. The locking tabs are bent into engagement with locking catches that project from the upstanding end walls to hold the side and end walls in end-to-end perpendicular alignment and thereby create the package for receiving the ingredients to be baked. Once folded, the corner portions will lie outside the enclosure. The locking tabs can be pulled out of their locking engagement with the locking catches to enable the previously-folded external corner portions to be unfolded and the package opened to permit the baked product to be iced or removed from the package.

BRIEF DESCRIPTION OF THE DRAWINGS

FIG. 1 shows a flat tray having a plurality of fold lines formed therein along which the tray is bent according to a first preferred embodiment of this invention to form a package in which to bake and ship baked goods, and the like;

FIG. 9 shows a flat tray having a plurality of fold lines formed therein along which the tray is bent according to a second preferred embodiment to form a package in which to bake and ship baked goods and the like;

FIG. 14 shows a flat tray having a plurality of fold lines formed therein along which the tray is bent according to a third preferred embodiment to form a package in which to bake and ship baked goods and the like;

DESCRIPTION OF THE PREFERRED EMBODIMENT

Figure 1:
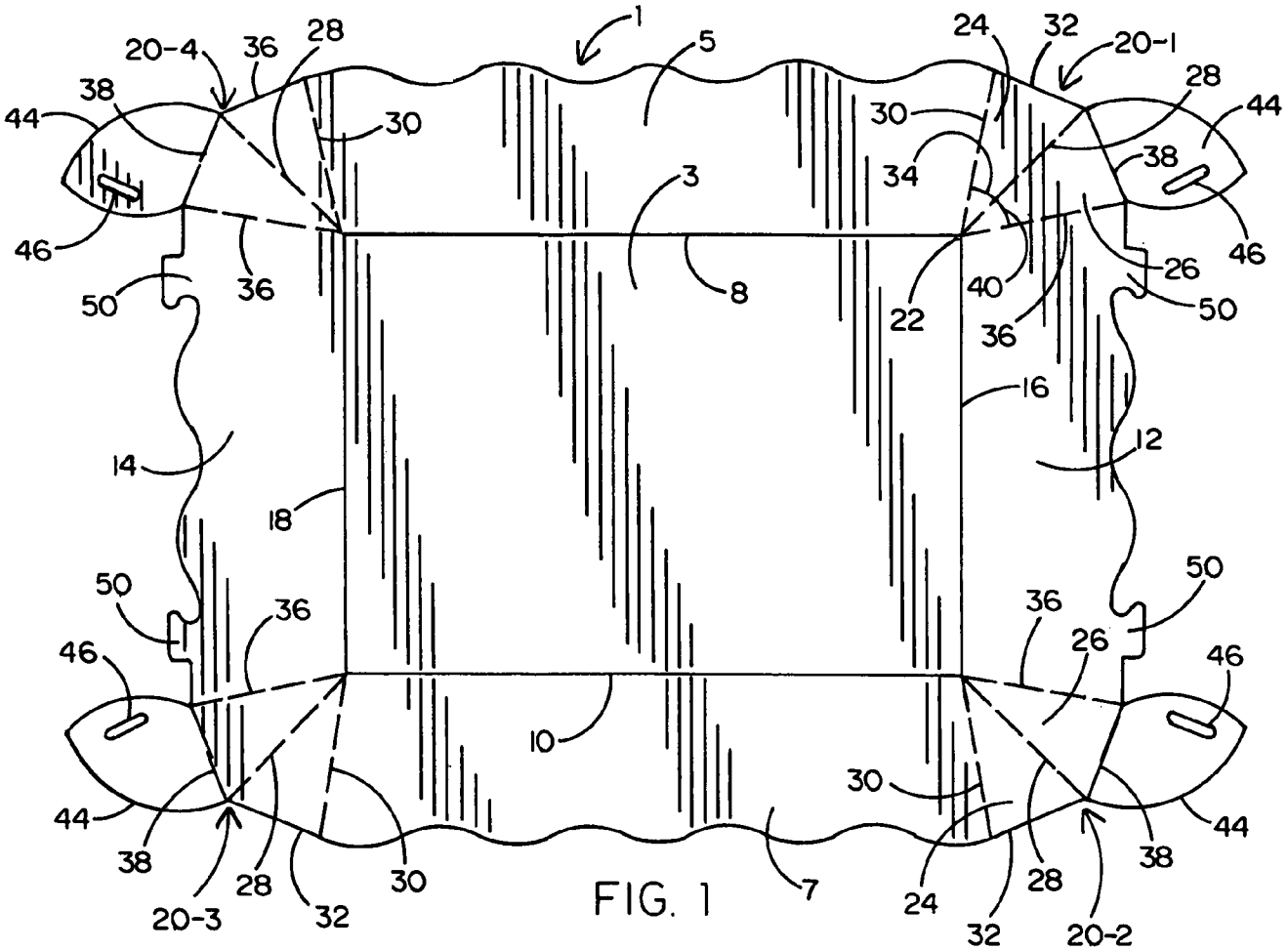

Referring initially to FIG. 1 of the drawings, there is shown a flat (i.e., unfolded) tray 1 according to a first preferred embodiment of this invention which can be quickly and easily folded to create a ready-to-use package (designated 60 and best shown in FIGS. 6-9) in which to add the ingredients (e.g., dough) for making goods (e.g., a cake) to be baked. The ingredients can be baked within the assembled package, and once the baking process has been completed, the finished product is ready to be wrapped and shipped to retailers and/or consumers. By virtue of its planar configuration prior to assembly, the unfolded tray 1 is capable of being stored in a stack with other flat trays located one above the other, whereby to facilitate transport and minimize space consumption. After the baked product has been purchased and consumed, the package may simply be discarded. To this end, the finished product may be advantageously baked, wrapped, shipped, displayed and consumed in a single package in order to streamline and reduce the cost commonly associated with production and distribution of baked goods.

As will now be explained, the flat tray 1 is inscribed with a series of fold lines (e.g., creases and perforations) along which the tray is folded to create an assembled baking and shipping package 60 (of FIGS. 6-9). The flat unfolded tray 1 is shown in FIG. 1 generally rectangular in shape. However, the actual shape and dimensions of the tray 1 will depend upon the product to be baked and shipped therein. By way of example, the tray 1 is preferably a single-wall corrugated recycled paper board having either a B, C, E, F or G fluting. The surface of the tray 1 on which the product will be cooked and ultimately transported is preferably treated with a conventional non-stick, moisture and oil-resistant coating that can withstand cooking temperatures in the range of 425 degrees F. for one hour.

At the center of the flat tray 1 is a (e.g., rectangular) base portion 3 which will be covered by the ingredients of the product to be baked and upon which the finished product will be seated and carried after the tray has first been folded to form the assembled baking and shipping package 60. Side walls 5 and 7 of the flat tray 1 are separated from the central base portion 3 by scored creases 8 and 10 running therebetween. End walls 12 and 14 of the flat tray 1 are separated from the central base portion 3 by scored creases 16 and 18 running therebetween.

The flat tray 1 includes four folding corners 20-1 . . . 20-4. Each folding corner angles outwardly from a corresponding one (e.g., 22) of the corners of the rectangular central base portion 3. Inasmuch as each folding corner 20-1 . . . 20-4 is identical to the others, the details of only one folding corner (e.g., 20-1) are provided herein. Identical reference numerals will be used to identify identical features of all of the folding corners 20-1 . . . 20-4 of the tray 1.

In particular, the folding corner 20-1 includes a pair of adjacent triangular fold-up panels 24 and 26 that are arranged side-by-side. The adjacent fold-up panels 24 and 26 are separated from one another by a perforated fold line 28 which forms a common side of the panels. The first triangular fold-up panel 24 includes a first side 30 which extends from the corner 22 of the central base portion 3 of tray 1 across the side wall 5. The triangular fold-up panel 24 includes a second side which corresponds to the common fold line 28. The second side (i.e., fold line 28) also extends from the corner 22 of the central base portion 3 across side wall 5. The third side 32 of the triangular fold-up panel 24 runs between the first side 30 thereof and the fold line 28. The first triangular panel 24 of the folding corner 20-1 of the flat tray 1 angles outwardly from the corner 22 of the central base portion 3 such that an acute angle 34 (e.g., of approximately 30 degrees) is formed between the first and second sides 30 and 28.

The second triangular fold-up panel 26 of the folding corner 20-1 of the flat tray 1 includes a first side 36 which extends from the corner 22 of the central base portion 3 of tray 1 across the end wall 12. The triangular fold-up panel 26 includes a second side which corresponds to the fold line 28 and is common to the second side of the first triangular fold-up panel 24. The third side 38 of the triangular fold-up panel 26 runs between the first side 36 thereof and the fold line 28. The second triangular panel 26 of the folding corner 20-1 angles outwardly from the corner 22 of the central base portion 3 such that an acute angle 40 (e.g., of approximately 30 degrees) is formed between the first and second sides 36 and 28.

Each of the fold lines from the first sides 30 and 36 of the first and second triangular fold-up panels 24 and 26 of folding corner 20-1 is preferably perforated through the tray 1 to facilitate folding therealong for an advantage that will soon be explained. The angle (including the sum of the angles 34 and 40) of the folding corner 20-1 which originates at the corner 22 of base portion 3 and extends between the perforated fold lines 30 and 36 is approximately 60 degrees.

A locking tab 44 is hingedly attached to the second triangular fold-up panel 26 of each of the folding corners 20-1 . . . 20-4 of the flat tray 1. In particular, the locking tabs 44 are joined to respective ones of the second fold-up panels 26 along the third side 38 of each panel 26. That is, the side 38 is common to each one of a fold-up panel 26 and an adjacent locking tab 44. The third side 38 is preferably a scored crease that is formed in the tray 1 and functions as a living hinge. An attachment slot 46 is cut or punched through each of the locking tabs 44.

A pair of locking catches 50 having hook ends projects outwardly from each of the end walls 12 and 14 of the flat tray 1. The pairs of locking catches 50 are located along the end walls 12 and 14 so that one locking catch lies adjacent one of the locking tabs 44 in order for the locking catch 50 and locking tab 44 to be connected together during the folding of tray 1 and the assembly of the package in which a baked product is cooked, transported and sold.

Figure 6:
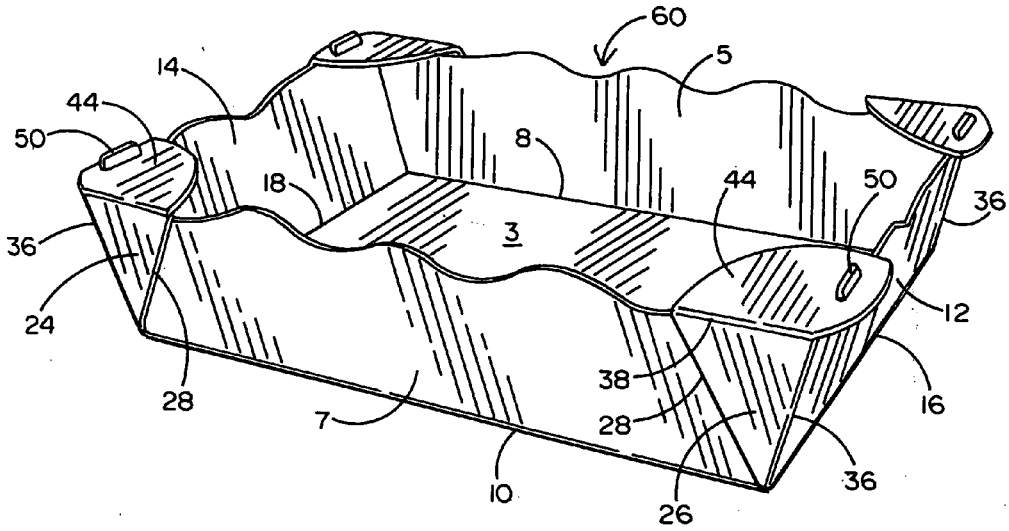
FIG. 6 shows the baking and shipping package formed after the flat tray of FIG. 1 has been folded along its fold lines.
Figure 7:
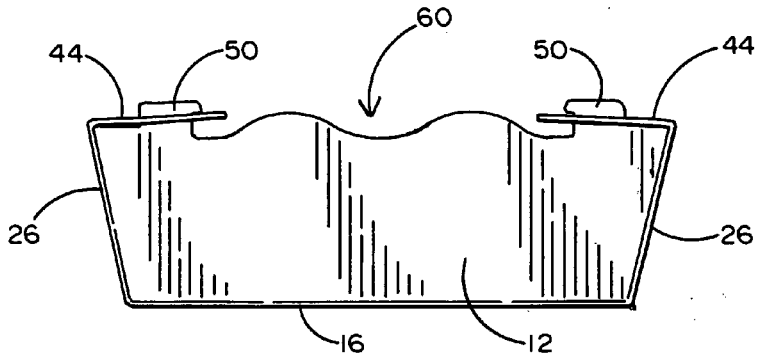
FIG. 7 is an end view of the package of FIG. 6.
Figure 8:
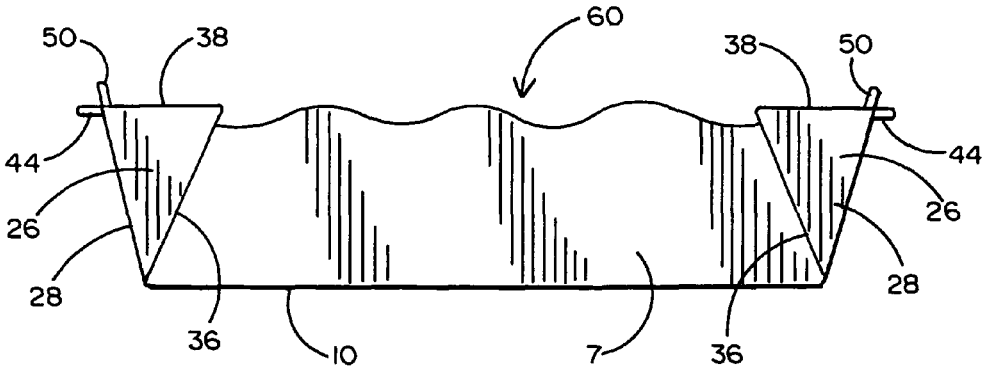
FIG. 8 is a side view of the package of FIG. 6.

Referring concurrently in this regard to FIGS. 1-5 of the drawings, the steps are now explained by which the flat unfolded tray 1 of FIG. 1 is folded to create the assembled package 60 of FIGS. 6-8. Initially, the side walls 5 and 7 as well as the end walls 12 and 14 surrounding the central base portion 3 are folded (i.e., bent) upwardly relative to the base portion along the creases 8, 10, 16 and 18 which are scored into the tray 1. Bending the side and end walls 5, 7, 12 and 14 as just described automatically closes and squares each of the folding corners 20-1 . . . 20-4 such that the walls 5, 7, 12 and 14 will be aligned end-to-end one another.

All of the folding corners 20-1 . . . 20-4 are closed in the same manner. For purposes of convenience, details are provided only with respect to the closure of the folding corner 20-2 shown in FIGS. 2-5. As the side wall 7 of tray 1 is folded upwardly relative to base portion 3 around the crease 10 and the end wall 12 is folded upwardly around the crease 16, the folding corner 20-2 folds up upon itself. That is to say, the triangular fold-up panel 24 of folding corner 20-2 is bent towards the adjacent triangular fold-up panel 26 (best shown in FIG. 3). In particular, the fold-up panel 24 is rotated (i.e., bent) in the direction of reference arrow 52 along the fold line established by the (perforated) side 28 that is common to both of the fold-up panels 24 and 26.

Figure 4:
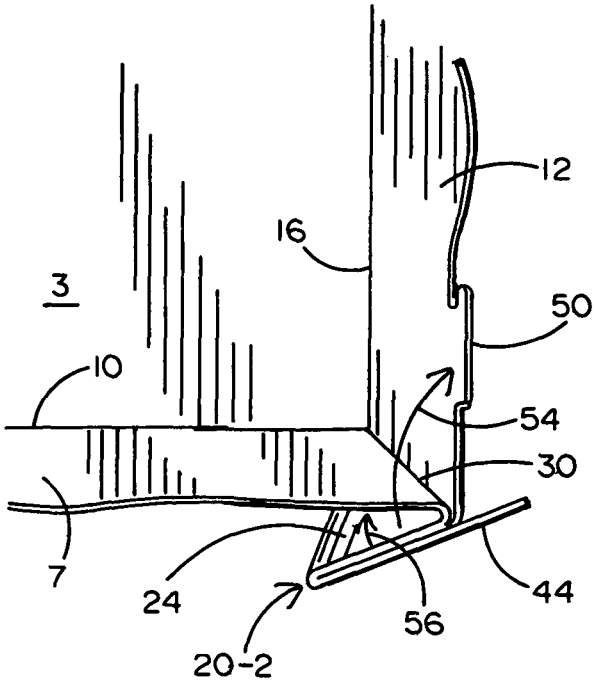
Figure 5:
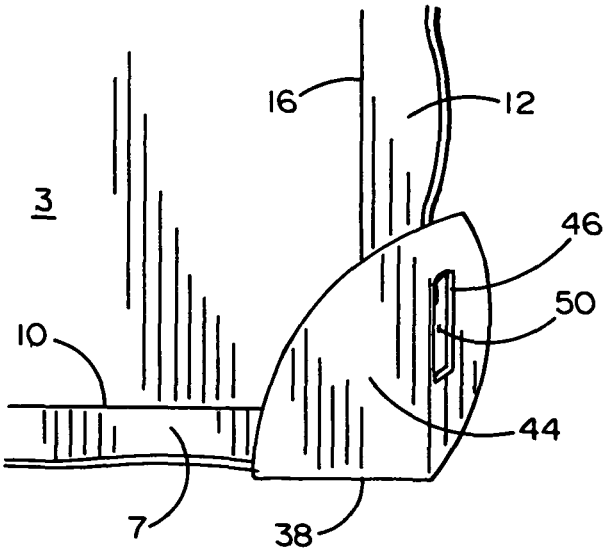

The fold-up panel 24 continues to rotate around its perforated side (i.e., fold line) 28 until panel 24 is moved face-to-face against panel 26 (best shown in FIG. 4). At the same time, the upturned side wall 7 and the adjacent end wall 12 surrounding the central base portion 3 are pulled into perpendicular end-to-end alignment with one another. The opposing face-to-face aligned fold-up panels 24 and 26 of folding corner 20-2 lie outside the package and adjacent the exterior of the side wall 7 with the locking tab 44 standing upwardly from the fold-up panel 26.

Figure 2:
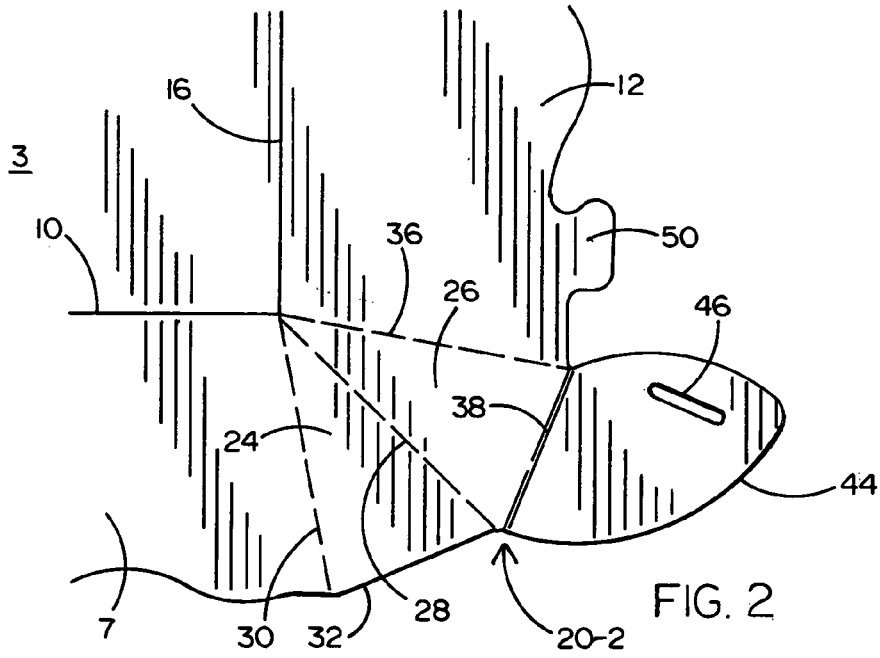
FIG. 2 is an enlarged detail showing one corner of the flat tray of FIG. 1.
Figure 3:
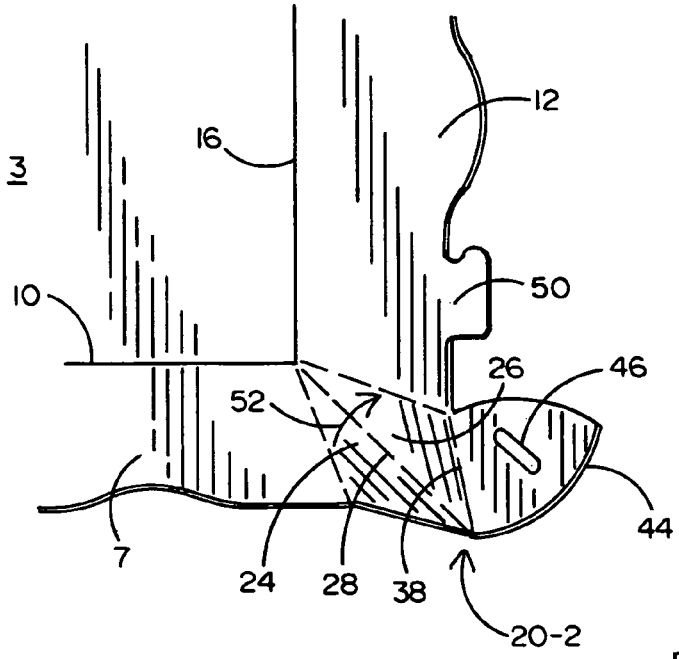
FIGS. 3-5 illustrate the steps by which the corner of the flat tray shown in FIG. 2 is folded to form a baking and shipping package.

In order to preserve the perpendicular alignment of the side and end walls 7 and 12 so as to hold the folding corner 20-2 closed and thereby prevent leakage throughout the baking process, the locking tab 44 is bent or folded downwardly (in the direction of the reference arrow 54 of FIG. 4) around the side 38 or hinge of the fold-up panel 26 which separates the locking tab 44 and the panel 26 (best shown in FIG. 2). The locking tab 44 is pulled over top the side wall 7 and towards the end wall 12 until the locking catch 50 which now stands upwardly from the upturned end wall 12 is received through the attachment slot 46 formed in locking tab 44 (best shown in FIG. 5). At the same time, the fold-up panel 24 is pulled against the outside of side wall 7 (in the direction of the reference arrow 56 of FIG. 4). Because of its hook-like end, the locking catch 50 is moved into locking engagement with the locking tab 44 at the attachment slot 46, whereby to hold the locking tab 44 down over the intersection of the perpendicularly-aligned side and end walls 7 and 12 to prevent the inadvertent separation (i.e., unfolding) thereof and an opening of the folding corner 20-2.

Once all four folding corners 20-1 . . . 20-4 (of FIG. 1) have been closed and locked as just described, the baking and shipping package 60 will be assembled and ready to receive the ingredients (e.g., dough) to be baked therein. A fully assembled package 60 is illustrated in FIGS. 6-8 of the drawings. The pairs of side walls 5 and 7 and end walls 12 and 14 are shown bent upwardly to establish an enclosure surrounding the central base portion 3. Thus, the central base portion 3 forms a flat, stable bottom for the assembled package 60. The package 60 and the ingredients therein can now be moved into an oven for baking. Following baking and cooling, the package and its contents can be wrapped, transported, displayed, sold and served without having to change packaging.

Once the ingredients within package 60 have been cooked, it may be necessary to open the package such as in those cases where the backed product will be covered with icing or removed from the package. Because the fold-up panels 24 and 26 of each of the closed corners 20-1 . . . 20-4 are held together and located outside the confines of the package 60, the corners may be easily opened to gain access to the baked product. To accomplish the foregoing, the locking tabs 44 are simply pulled upwardly and out of their locking engagement with the locking catches 50. The fold-up panels 24 and 26 of each corner may now be rotated apart and away from their face-to-face alignment. The corners 20-1 . . . 20-4 of the package 60 can be partially or completely opened on an as-needed basis. Once access to the baked product is completed, the corners 20-1 . . . 20-4 may once again be closed in the manner previously described so that the product surrounded by the package 60 may continue to move through the production process.

Figure 9:
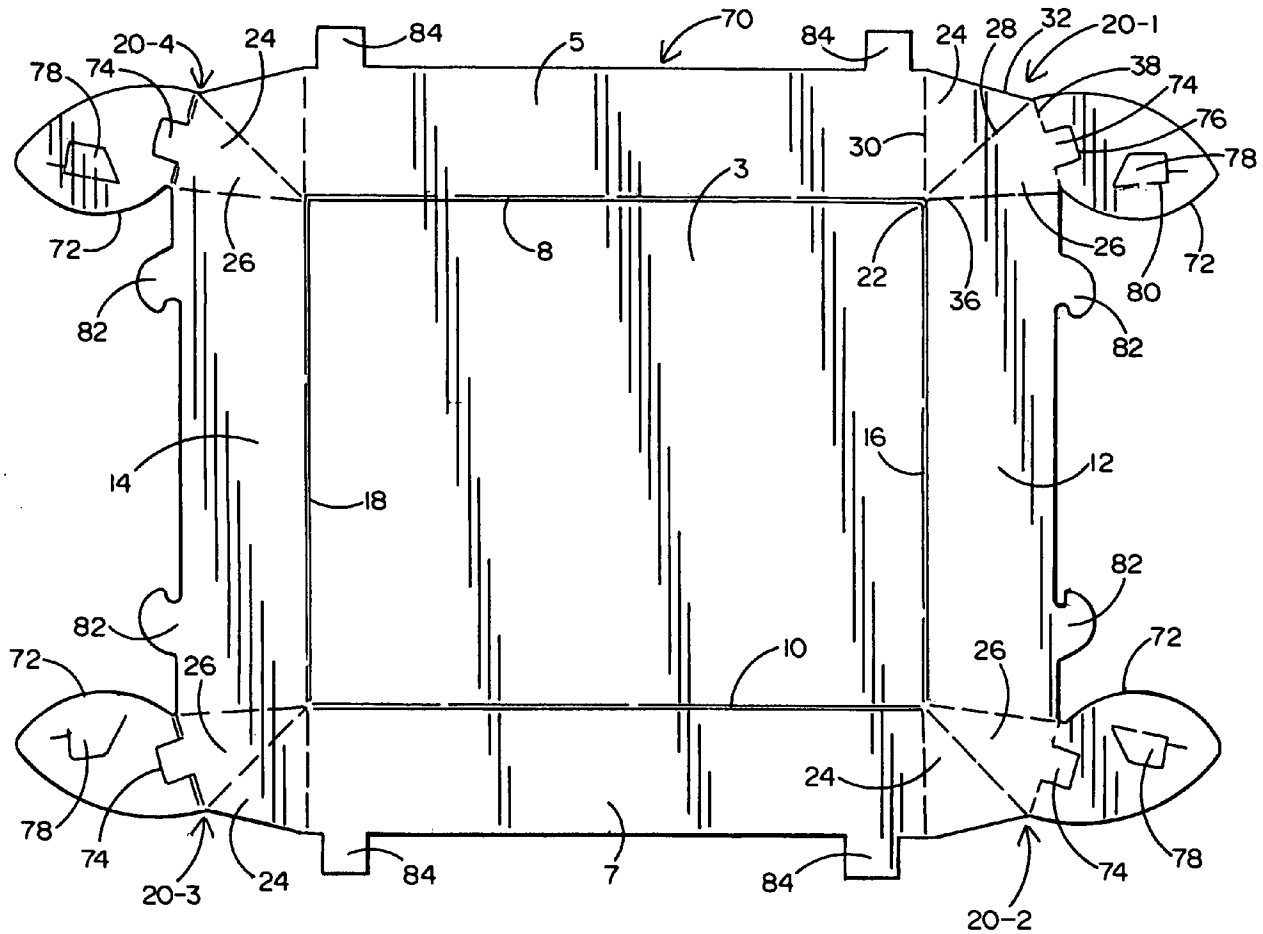
Figure 10:
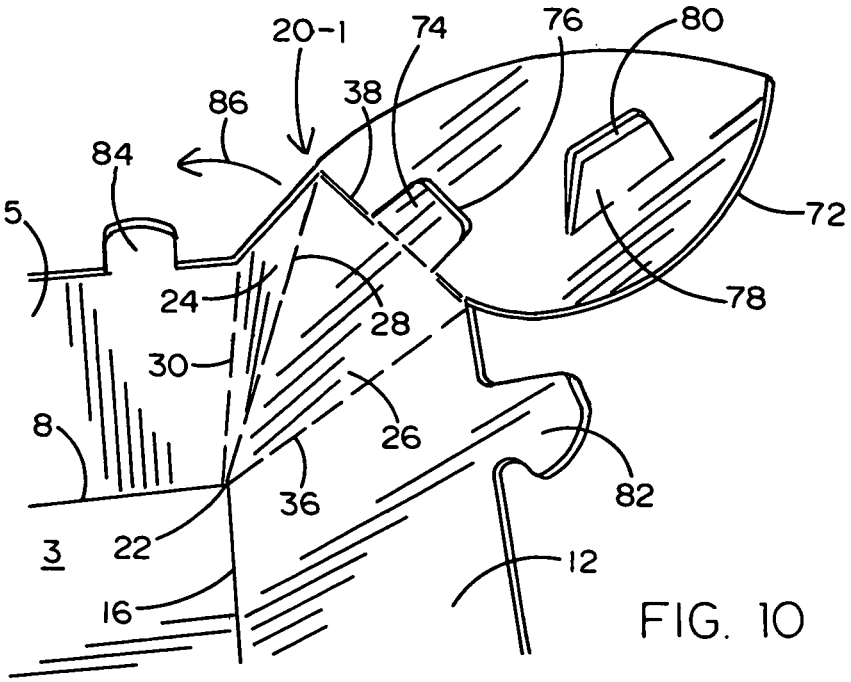
FIGS. 10-12 illustrate the steps by which one corner of the flat tray shown in FIG. 9 is folded to form a baking and shipping package.

Turning now to FIG. 9 of the drawings, there is shown a flat (i.e., unfolded) tray 70 according to a second preferred embodiment of this invention which can be quickly and easily folded to create a ready-to-use baking and shipping package (designated 88 in FIG. 13) to achieve the same advantages as those associated with the package 60 shown in FIGS. 6-8. The flat tray 70 of FIG. 9 has many features which are common to features of the flat tray 1 shown in FIG. 1. Therefore, for purposes of convenience, identical reference numerals will be used to designate the common features of the trays 1 and 70, and no additional description thereof will be provided.

As in the case of the tray 1 of FIG. 1, a locking tab 72 is hingedly attached to the triangular fold-up panel 26 of each of the folding corners 20-1 . . . 20-4 of the flat tray 70 of FIG. 9. The locking tabs 72 are joined to respective ones of the fold-up panels 26 along the third side 38 of each panel. Each fold-up panel 26 at each folding corner (e.g., 20-1) of the tray 70 has a co-extensive locking projection 74 extending outwardly from the third side 38 thereof into the locking tab 72. The locking projection 74 is initially and removably received within a locking cavity 76 (best shown in FIG. 12) that is formed through the locking tab 72. A push-out locking flap 78 is hingedly connected to the locking tab 72 so as to be initially and rotatably received within a locking receptacle 80 (best shown in FIG. 13) that is cut into the locking tab.

A pair of locking catches 82 have hook ends project outwardly from each of the end walls 12 and 14 of the flat tray 70. The pairs of locking catches 82 are located along the end walls 12 and 14 so that one locking catch lies adjacent one of the locking tabs 72 in order for the locking catch 82 and the locking tab 72 to be connected together during the folding of tray 70 and the assembly of the package 88. A pair of locking reinforcements 84 extend outwardly from each of the side walls 5 and 7 of the flat tray 70. The pairs of locking reinforcements 84 are located along the side walls 5 and 7 so that one locking reinforcement 84 lies adjacent one of the folding corners (e.g., 20-1) of tray 70 in order for the locking reinforcement and one of the locking tabs 72 to be connected together during folding of the tray as will now be described.

Figure 11:
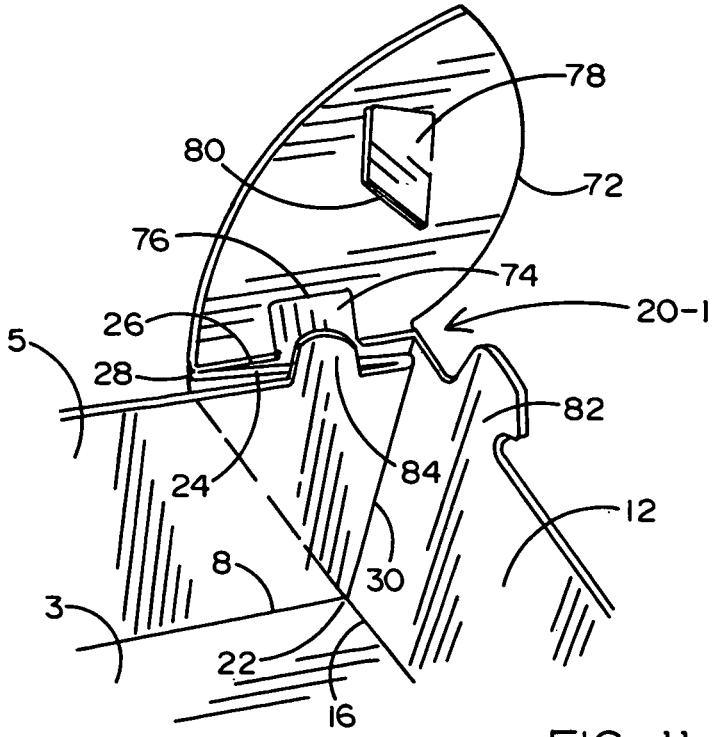
Figure 12:
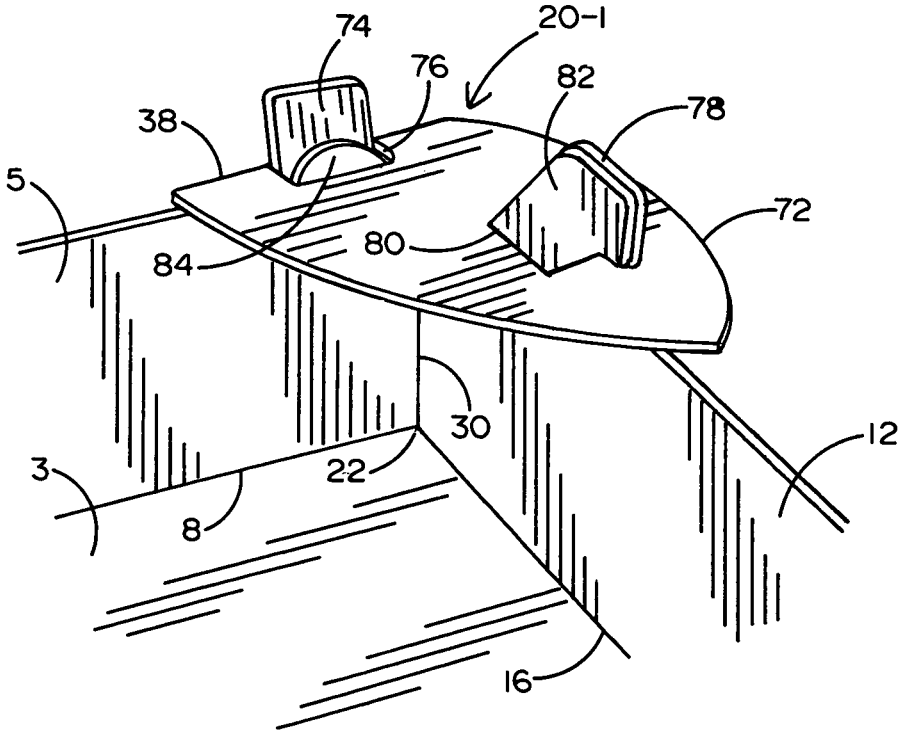
Figure 13:
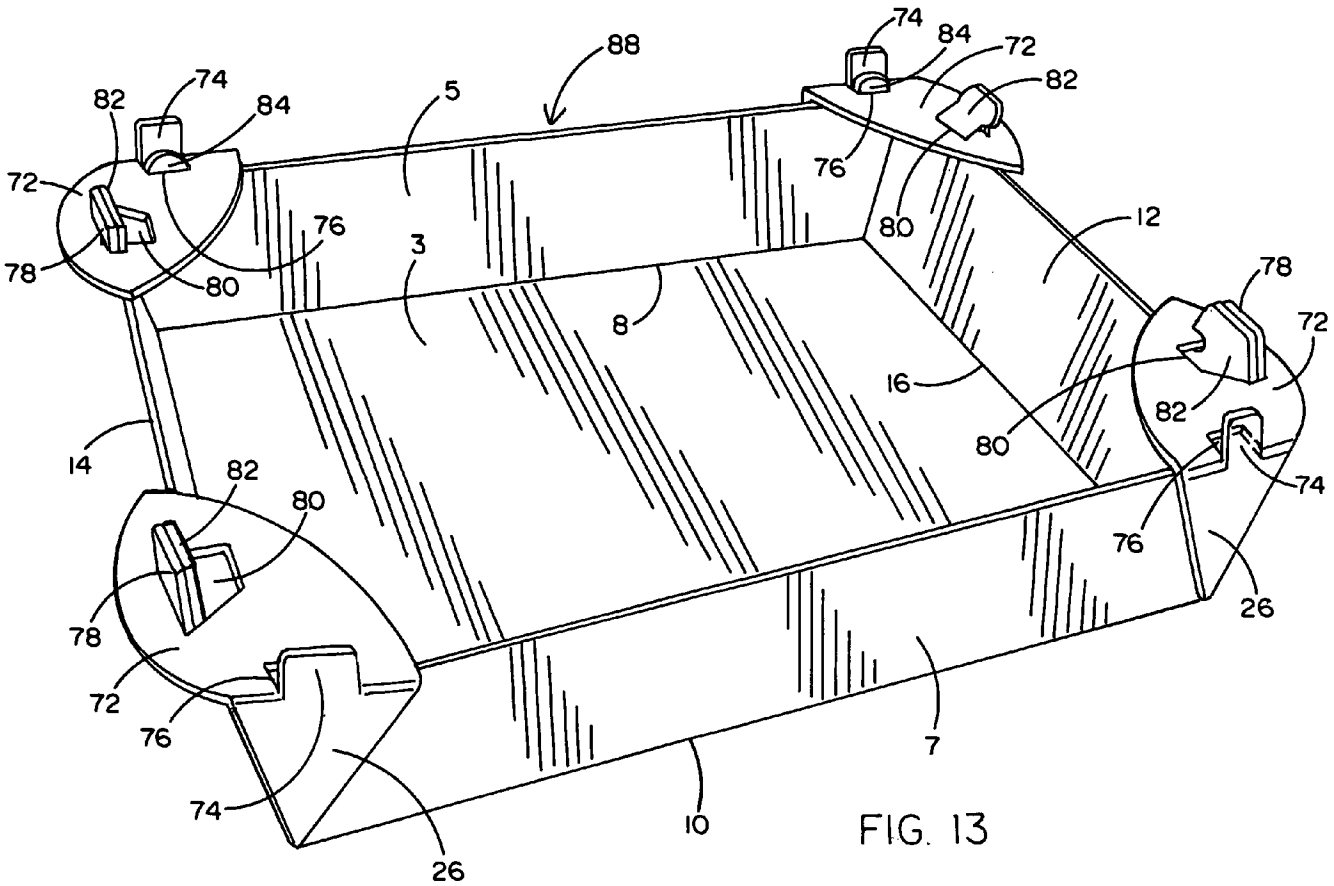
FIG. 13 shows the baking and shipping package formed after the flat tray of FIG. 9 has been folded along its fold lines.

Referring concurrently in this regard to FIGS. 9-12 of the drawings, the steps are now explained by which the flat unfolded tray 70 of FIG. 9 is folded to create the assembled package 88 with folded and locked corners as shown in FIG. 13. Initially, the side walls 5 and 7 as well as the end walls 12 and 14 surrounding the central base portion 3 are folded (i.e., bent) upwardly relative to the base portion along the creases 8, 10, 16 and 18 which are scored into the tray 1. Bending the side and end walls 5, 7, 12 and 14 as just described automatically closes and squares each of the folding corners 20-1 . . . 20-4 such that the walls 5, 7, 12 and 14 will be aligned end-to-end one another.

All of the folding corners 20-1 . . . 20-4 are closed and locked in the same manner. For purposes of convenience, details are provided only with respect to the closure and locking of the folding corner 20-1 shown in FIGS. 9-12. As the side wall 5 of tray 70 is folded upwardly relative to base portion 3 around the crease 8 and the end wall 12 is folded upwardly around the crease 16, the folding corner 20-1 folds up upon itself. That is to say, the triangular fold-up panel 26 of folding corner 20-1 is bent towards the adjacent triangular fold-up panel 24 (best shown in FIG. 10). In particular, the fold-up panel 26 is rotated (i.e., bent) along the fold line established by the (perforated) side 28 that is common to both of the fold-up panels 24 and 26.

The fold-up panel 26 continues to rotate towards fold-up panel 24, and panel 24 rotates around its first side (i.e., fold line) 30 until both panels 26 and 24 are moved (in the direction of reference arrow 86) into face-to-face alignment against side wall 5 (best shown in FIG. 11). At the same time, the upturned side wall 5 and the adjacent upturned end wall 12 surrounding the central base portion 3 are pulled into perpendicular end-to-end alignment with one another. The opposing face-to-face aligned fold-up panels 24 and 26 of folding corner 20-1 lie outside the package and adjacent the exterior of the side wall 5 with the locking tab 72 standing upwardly from the fold-up panel 26.

In order to preserve the perpendicular alignment of the side and end walls 5 and 12 so as to hold the folding corner 20-1 closed and thereby prevent leakage throughout the baking process, the locking tab 72 is bent and folded downwardly towards the locking catch 82 around the side 38 or hinge of the fold-up panel 26 which joins the locking tab 72 and the panel 26. The locking tab 72 is pulled over top the side wall 5 and against the end wall 12 until the locking catch 82 which now stands upwardly from the upturned end wall 12 is received through the locking receptacle 80 formed through the locking tab 72 (best shown in FIG. 12).

The receipt of the locking catch 82 through the locking receptacle 80 rotates the push-out locking flap 78 upwardly and out of the locking receptacle. Because of its hook end, the locking catch 82 is disposed in locking engagement with the locking tab 72 at the locking receptacle 80. The push-out locking flap 78 lies alongside and supports the locking catch 82 so as to prevent an unintended disconnection of locking catch 82 from locking tab 78 via locking receptacle 80. The locking catch 82 holds the locking tab 72 down over the intersection of the perpendicularly-aligned side and end walls 5 and 12 so as to avoid a separation (i.e., unfolding) thereof and prevent the closed folding corner 20-1 from opening.

As the locking catch 82 engages the locking tab 72, the locking reinforcement 84 which extends from the now upstanding side wall 5 is received through the locking cavity 76 formed in locking tab 72 (also best shown in FIG. 12). The receipt of locking reinforcement 84 through the locking cavity 76 pushes the locking projection 74 of locking tab 72 upwardly and out of the locking cavity. The locking projection 74 lies alongside and supports the locking reinforcement 84 so as to prevent a displacement of the locking tab 72 and reinforce the closure of the folding corner 20-1.

Once all four folding corners 20-1 . . . 20-4 (of FIG. 9) have been closed and locked as just described, the baking and shipping package 88 will be assembled and ready to receive the ingredients (e.g., dough) to be baked therein. A fully assembled package 88 is illustrated in FIG. 13 of the drawings. The pairs of side walls 5 and 7 and end walls 12 and 14 are shown bent upwardly to establish an enclosure surrounding the central base portion 3. Thus, the central base portion 3 forms a flat, stable bottom for the assembled package 88. The package 88 and the ingredients therein are now ready to be baked, wrapped, transported and sold without having to change packages. However, should the package 88 need to be opened during the manufacturing process, the locking tabs 72 may be pulled upwardly and off the locking catches 82 as was earlier described for the package 60 of FIGS. 6-8.

Figure 14:
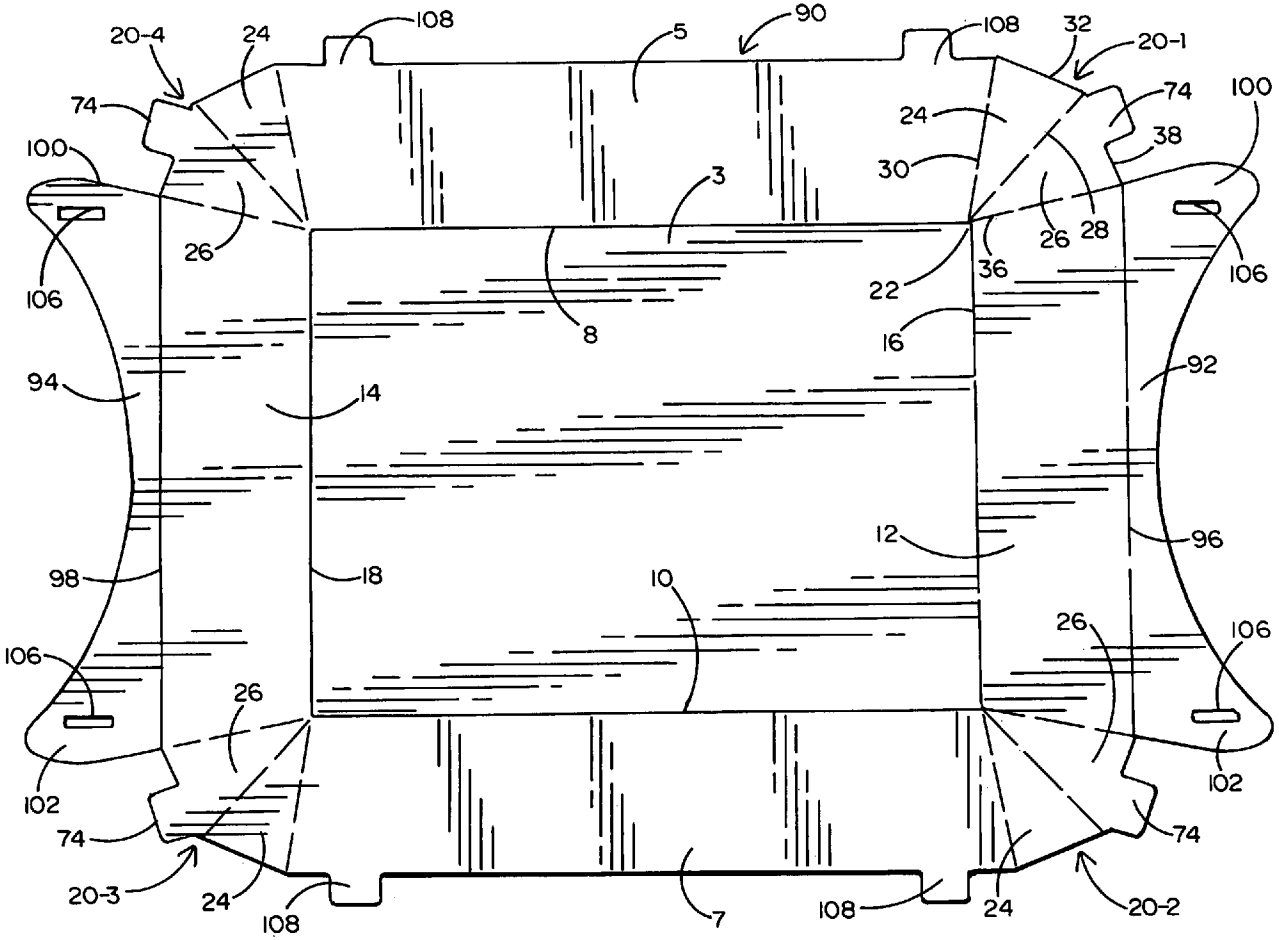
Figure 15:
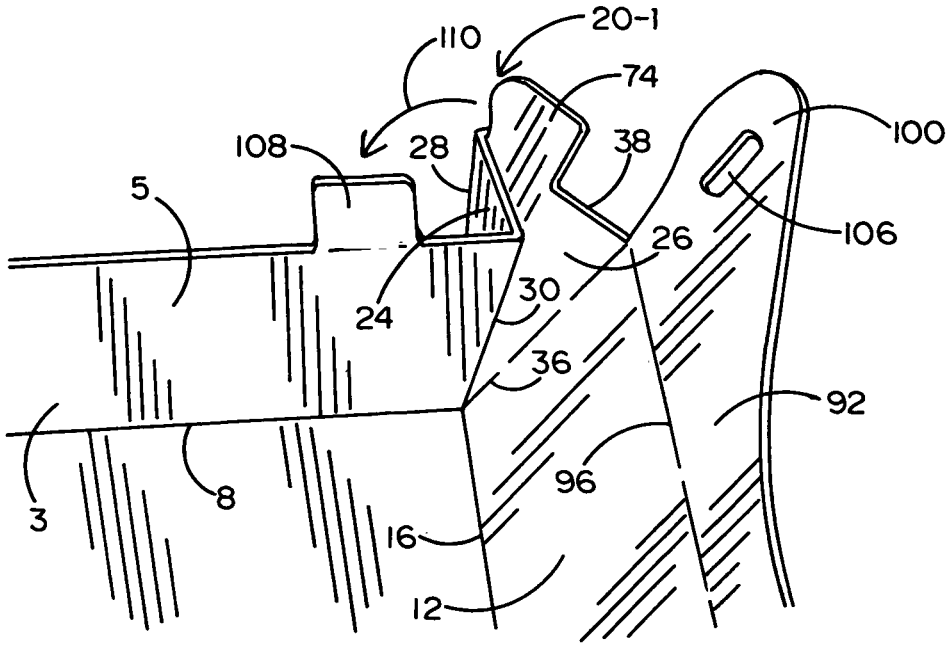
FIGS. 15 and 16 illustrate the steps by which one corner of the flat tray shown in FIG. 14 is folded to form a baking and shipping package.
Figure 17:
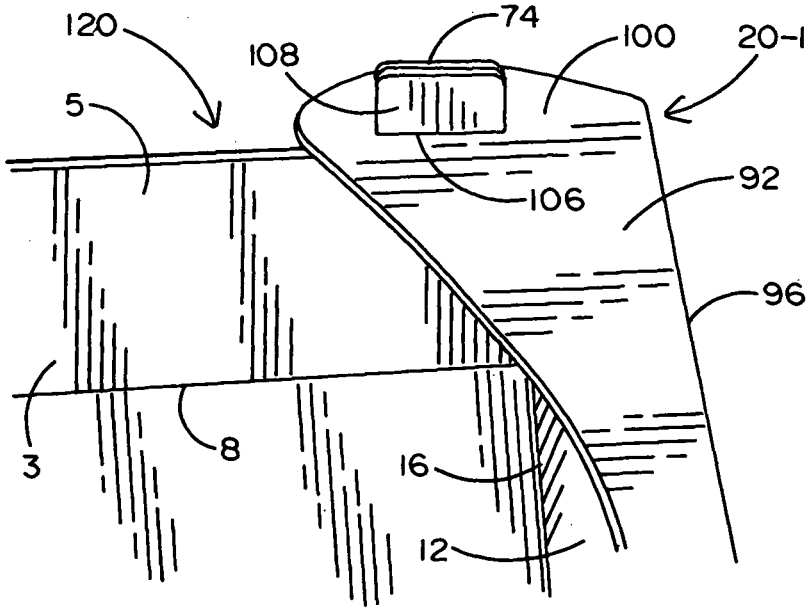
FIG. 17 shows the baking and shipping package formed after the flat tray of FIG. 14 has been folded along its fold lines.

Referring to FIG. 14 of the drawings, there is shown a flat (i.e., unfolded) tray 90 according to a third preferred embodiment of this invention to be folded into a ready-to-use baking and shipping package (designated 120 in FIG. 17). The flat tray 90 has many features which are common to features of the flat tray 70 shown in FIG. 9. Therefore, for purposes of convenience, identical reference numerals will be used to designate the common features of trays 70 and 90, and no additional description thereof will be provided.

Locking flaps 92 and 94 are hingedly attached to respective ones of the end walls 12 and 14 of tray 90 along fold lines 96 and 98. Each of the locking flaps 92 and 94 has an upturned ear 100 and 102 located at each of the opposite ends thereof. A locking slot 106 is formed through each of the upturned ears 100 and 102 of the locking flaps 92 and 94. A locking projection 108 extends outwardly from each end of each of the side walls 5 and 7 of tray 90 adjacent the folding corners 20-1 . . . 20-4. The locking projections 108 are sized and shaped to match the size and shape of the locking projections 74 which extend from the triangular fold-up panels 26 of folding corners 20-1 . . . 20-4.

Referring concurrently to FIGS. 14-17 of the drawings, the steps are now explained by which the flat unfolded tray 90 of FIG. 14 is folded to create a package 120 with folded and locked corners as shown in FIG. 17. Initially, the side walls 5 and 7 as well as the end walls 12 and 14 surrounding the central base portion 3 are folded (i.e., bent) upwardly relative to the base portion along the creases 8, 10, 16 and 18 which are scored into the tray 90. Bending the side and end walls 5, 7, 12 and 14 automatically closes and squares each of the folding corners 20-1 . . . 20-4 such that walls 5, 7, 12 and 14 will be aligned end-to-end one another.

All of the folding corners 20-1 . . . 20-4 are closed and locked in the same manner. For purposes of convenience, details are provided only with respect to the closure and locking of the folding corner 20-1. As the wall 5 of tray 90 is folded upwardly relative to the base portion 3 around the crease 8 and the end wall 12 is folded upwardly around the crease 16, the folding corner 20-1 folds up upon itself. That is, the triangular fold-up panel 26 is bent towards the adjacent triangular fold-up panel 24 (best shown in FIG. 15). In particular, the fold-up panel 26 is rotated (i.e., bent) along the fold line established by the perforated side 28 that is common to both of the fold-up panels 24 and 26.

Figure 16:
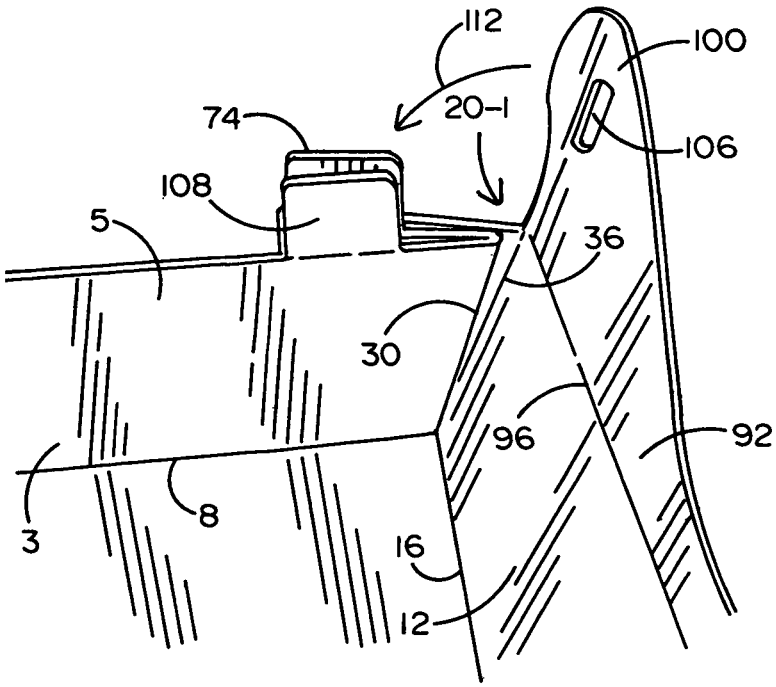

The fold-up panel 26 continues to rotate towards the fold-up panel 24, and panel 24 rotates around its first side (i.e., fold line) 30 until both panels 26 and 24 are moved (in the direction of reference arrow 110) into face-to-face alignment against the side wall 5 (best shown in FIG. 16). At the same time, the upturned side wall 5 and the adjacent end wall 12 which surround the central base portion 3 are pulled into perpendicular end-to-end alignment with one another. The opposing face-to-face aligned fold-up panels 24 and 26 of folding corner 20-1 lie outside the package and adjacent the exterior of the side wall 5. The respective locking projections 74 and 108 which now stand upwardly from fold-up panel 26 and side wall 5 also lie face-to-face one another (best shown in FIG. 17).

In order to preserve the perpendicular alignment of the side and end walls 5 and 12 so as to hold the folding corner 20-1 closed and thereby prevent leakage throughout the baking process, the locking flap 92 is bent around the fold line 96 and folded downwardly towards the face-to-face aligned locking projections 74 and 108 (in the direction of reference arrow 112 of FIG. 16). The locking flap 92 is pulled over top the adjacent side and end walls 5 and 12 until the locking projections 74 and 108 are received through the locking slot 106 formed in the ear 100 of locking flap 92 (best shown in FIG. 17).

The pair of locking projections 74 and 108 create a sufficient thickness and locking force within the locking slot 106 to prevent an unintended separation of the locking flap 92 from the locking projections. That is, the receipt of the locking projections 74 and 108 within the locking slot 106 holds the locking flap 92 down over the intersection of the perpendicularly-aligned side and end walls 5 and 12 so as to avoid a separation (i.e., unfolding) thereof and prevent the closed folding corner 20-1 from opening.

Once all four folding corners 20-1 . . . 20-4 (of FIG. 14) have been closed and locked as just described, the baking and shipping package 120 of FIG. 17 will be assembled and ready to receive the ingredients to be baked therein. However, as with the previously described packages 60 and 88 of FIGS. 6 and 13, the package 120 can be opened during the manufacturing process by pulling the locking flap 92 upwardly and out of its engagement with the locking projections 74 and 108.

The invention claimed is:

1. A tray having a set of fold lines along which said tray is folded to create a package in which a product is carried, said tray comprising:

a base portion;

a first pair of walls, each of said first pair of walls being hingedly joined to the base portion by respective ones of said set of fold lines;

a second pair of walls, each of said second pair of walls being hingedly joined to the base portion by respective different ones of said set of fold lines, such that each wall of said first pair of walls lies adjacent a wall of said second pair of walls;

a pair of locking flaps connected to respective ones of said second pair of walls;

a plurality of folding corners, each of said folding corners having a fold line along which to be folded and each folding corner being located between one wall from said first pair of walls and an adjacent wall from said second pair of walls;

a first plurality of locking tabs projecting from said plurality of folding corners;

a second plurality of locking tabs projecting from said first pairs of walls;

a plurality of locking slots formed in each of said pair of locking flaps;

said first and second pairs of walls being bendable upwardly relative to said base portion along the respective fold lines at which said pairs of walls are hingedly joined to said base portion so that said pairs of walls stand upwardly from said base portion and lie end-to-end one another around said base portion;

said plurality of folding corners standing upwardly with said first and second pairs of walls and being foldable along the fold lines thereof, said upwardly standing folding corners being rotatable towards said first pair of upwardly standing walls such that the first plurality of locking tabs projecting from said plurality of folding corners are correspondingly rotated so as to lie face-to-face with respective ones of the second plurality of locking tabs projecting from said first pair of walls; and said pair of locking flaps being bendable downwardly at the connection thereof to said second pair of walls towards said base portion so that pairs of locking tabs from said first and second pluralities of locking tabs which lie face-to-face are held in interlocking engagement with said locking flaps through respective ones of said pluralities of locking slots formed in said pair of locking flaps.

2. The tray recited in claim 1, wherein each of said second pair of upwardly standing walls has a locking flap connected thereto by a different one of a set of fold lines, the locking flaps being bendable downwardly towards said base portion along respective ones of said different fold lines.

3. The tray recited in claim 1, wherein the locking flaps connected to the second pair of upwardly standing walls lie above the first pair of upwardly standing walls relative to said base portion.

4. The tray recited in claim 1, wherein each of said plurality of folding corners includes first and second panels that are separated from one another by the fold line of each folding corner, said first and second panels being rotatable towards each other along said fold line so as to lie face-to-face one another at the exterior of said package and outside said first and second pairs of upwardly standing walls when said first and second pairs of upwardly standing walls lie end-to-end one another around said base portion.

5. The tray recited in claim 4, wherein said base portion is a rectangle, and wherein the first and second panels of each folding corner are triangles, each triangle having a pair of sides that intersect one another at a corner of said base portion.

6. The tray recited in claim 4, wherein each of said plurality of upstanding folding corners having the first and second panels thereof rotated so as to lie face-to-face one another is responsive to a rotational force to cause each folding corner to correspondingly rotate towards and lie against one of said first pair of upwardly standing walls.

* * * * *